United States Patent [19]

Tyree, Jr.

[11] 4,186,562

[45] Feb. 5, 1980

[54] CRYOGENIC REFRIGERATION FOR VEHICLES

[76] Inventor: Lewis Tyree, Jr., 145 Briarwood Ave., North, Oak Brook, Ill. 60521

[21] Appl. No.: 927,455

[22] Filed: Jul. 24, 1978

Related U.S. Application Data

[63] Continuation-in-part of Ser. No. 737,440, Nov. 1, 1976, Pat. No. 4,127,008.

[51] Int. Cl.[2] ..... F17C 7/02

[52] U.S. Cl. ..... 62/62; 62/48; 62/165; 62/239; 62/514 R

[58] Field of Search ..... 62/62, 48, 45, 165, 62/239, 514 R

[56] References Cited

U.S. PATENT DOCUMENTS

| | | | |
|---|---|---|---|
| 3,754,407 | 8/1973 | Tyree, Jr. | 62/62 |
| 3,810,365 | 5/1974 | Hampton et al. | 62/48 |
| 3,984,993 | 10/1976 | Muska | 62/45 |
| 3,994,141 | 11/1976 | Schräwer | 62/514 R |
| 4,015,437 | 4/1977 | Daus | 62/514 R |

*Primary Examiner*—Ronald C. Capossela

*Attorney, Agent, or Firm*—Fitch, Even & Tabin

[57] ABSTRACT

A cargo compartment of a refrigerated vehicle is cooled by a cryogen, such as carbon dioxide. A storage tank carried by the vehicle is filled with $CO_2$ slush. Liquid $CO_2$ is separated from solid $CO_2$ and supplied to a heat-exchanger where it is vaporized and the vapor is warmed by heat transfer from the cargo compartment atmosphere. A minimum vapor pressure of at least about 75 psia is maintained in the heat-exchanger, and a portion of the vapor is returned to the vehicle tank, melting solid $CO_2$ therein. The major portion of the vapor stream is expanded through one or more gas motors, passed through one or more additional heat-exchangers to cool the cargo compartment and then vented. The pressure of the returning vapor is preferably increased by a compressor attached to a gas motor and injected into the vehicle tank.

17 Claims, 3 Drawing Figures

Fig. 1.
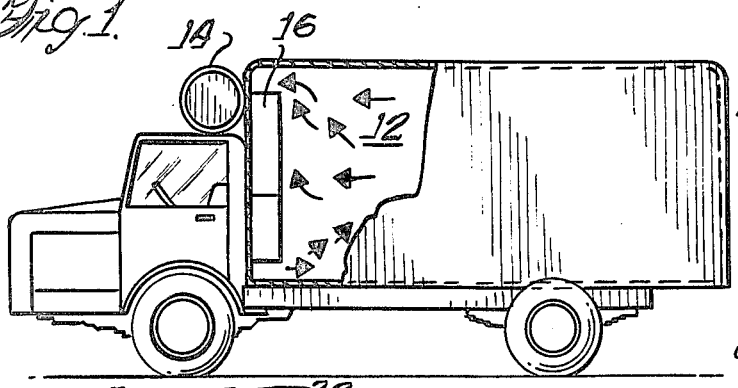
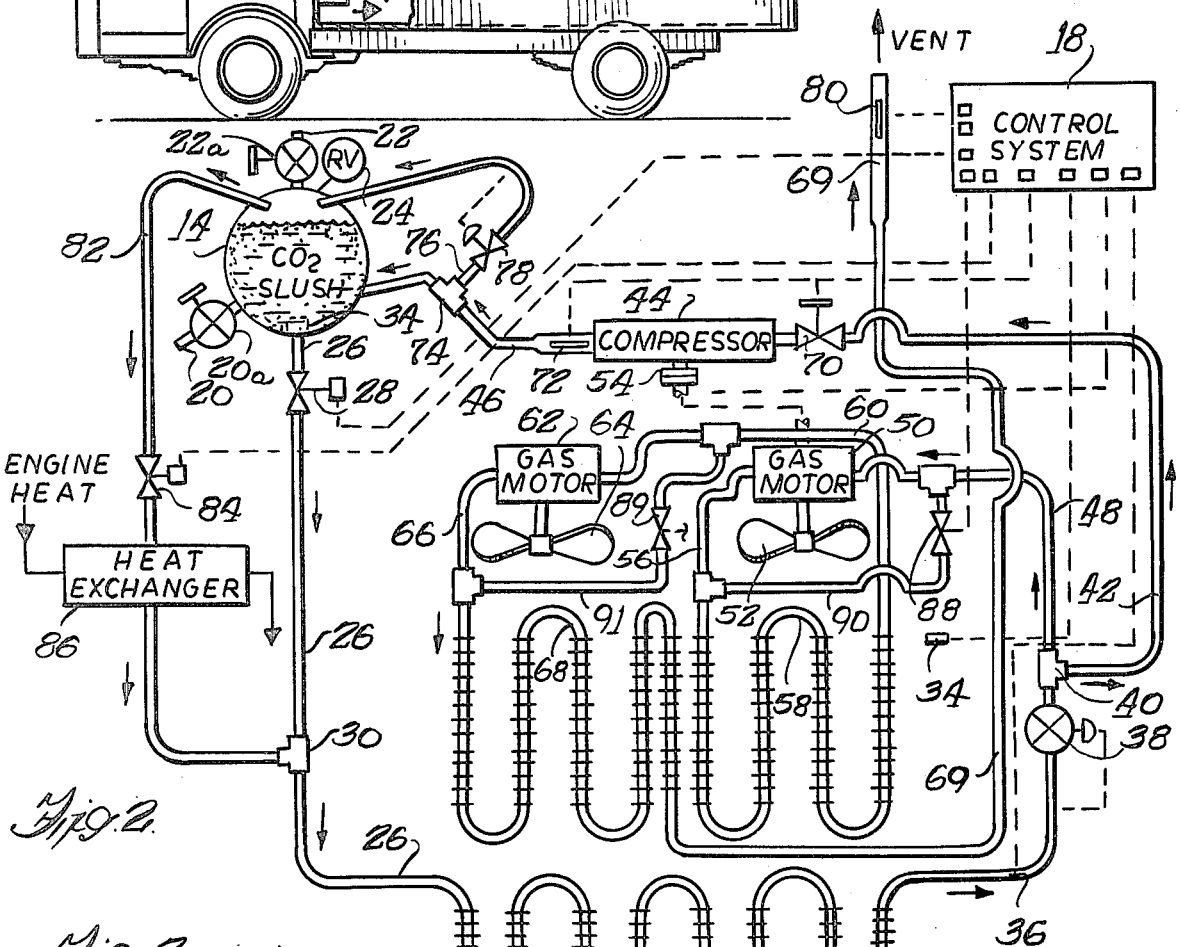
Fig. 2.
Fig. 3.
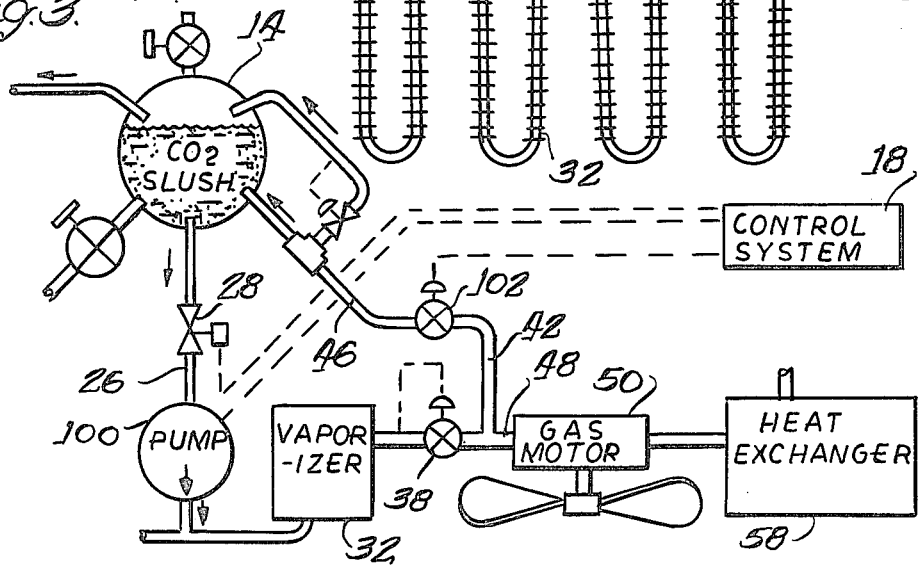

CRYOGENIC REFRIGERATION FOR VEHICLES

This application is a continuation-in-part of my copending application Ser. No. 737,440, filed Nov. 1, 1976 now U.S. Pat. No. 4,127,008.

My U.S. Pat. No. 4,045,972, issued Sept. 6, 1977 and entitled "$CO_2$ Cooling of Vehicles", discloses a system for employing carbon dioxide to effect the cryogenic cooling of the cargo compartment of a refrigerated vehicle. The system is particularly advantageous for delivery trucks, or the like, wherein it is necessary for the driver to frequently enter the cargo compartment and thus it is preferable to maintain an air atmosphere therein from a safety standpoint. Accordingly, the disclosed system vents the warmed cryogen vapor to the atmosphere so that it has no effect upon the oxygen supply within the cargo compartment. Although the systems illustrated in this patent are considered to be substantial improvements over the prior art systems, further improvements are always sought after.

Heretofore, cryogenic cooling on a relatively large scale, as for example of the refrigeration compartment of a truck or railroad boxcar or of the output of a food-processing plant, has generally been effected by using an expendable cryogen which is vented to the atmosphere after it has accomplished its objective of absorbing heat. However, the rising cost of energy throughout the world has caused changes in the economic viewpoint when cryogenic refrigeration is concerned. My above-identified U.S. Pat. No. 4,127,008 discloses various systems for utilizing cryogenic refrigeration which have economic advantages, particularly from an energy standpoint. The present application incorporates this basic concept in a vehicle refrigeration system.

The present invention provides an arrangement for cooling the cargo compartment of a refrigerated vehicle using a cryogen, such as carbon dioxide, wherein the storage tank carried by the vehicle is provided with a quantity of cryogen slush, for example a mixture or slurry of solid $CO_2$ in liquid $CO_2$ at the triple point. Liquid $CO_2$ from the tank is transferred to a heat-exchanger where it vaporizes by absorbing heat from the cargo compartment atmosphere. $CO_2$ vapor from the heat-exchanger is returned to the vehicle storage tank where it melts solid $CO_2$ in the slush, forming additional liquid $CO_2$. So long as slush exists in the vehicle storage tank, there is return of $CO_2$ vapor to the tank, and preferably the vapor is condensed by direct contact with the solid $CO_2$ in the tank to provide additional liquid $CO_2$ which is then available for subsequent vaporization.

These and other advantages of the invention will be apparent from the following detailed description of certain preferred embodiments of the invention, when read in conjunction with the accompanying drawings wherein:

FIG. 1 is a side elevation view of a delivery truck incorporating a carbon dioxide refrigeration system embodying various features of the invention;

FIG. 2 is a schematic view of the carbon dioxide refrigeration system which is incorporated in the vehicle depicted in FIG. 1; and FIG. 3 is a fragmentary schematic view, similar to FIG. 2, of an alternative embodiment of a refrigeration system embodying various features of the invention.

FIG. 1 illustrates a delivery truck 10 of a type which might be used on a daily delivery route where the driver will make a number of stops where he will enter the cargo compartment 12 of the truck to remove refrigerated products for delivery to customers. The truck 10 includes an insulated storage tank or vessel 14 which is located on the front wall of the truck body above the cab. Alternatively, the storage tank could be located on the underside of the truck as explained hereinafter.

The tank 14 is designed to safely withstand the pressure of the cryogen which is to be employed. Carbon dioxide is much the preferred cryogen, although other cryogens from which slush can be formed under reasonable conditons might conceivably be employed, as for example nitrogen or argon (except for its expense). When carbon dioxide is employed, the contents of the storage tank 14 will be at the triple point, i.e., about 75 psia and about −70° F., and the design specifications of the tank will be set accordingly, pursuant to usual safety considerations.

As depicted in FIG. 1, the heat-exchange system is preferably located within the cargo compartment 12 inside of an enclosure 16 which is open at the top and bottom so as to create a circulation of the cargo compartment atmosphere, as indicated by the arrow pattern, by drawing the warm atmosphere into the top of the enclosure. The system is operated by a control system 18 which may be located exterior of the cargo compartment 12 for easy accessibility.

As depicted in FIG. 2, the storage tank 14 is provided with a liquid fill line 20 and a vapor return line 22, both of which are provided with manual shutoff valves **20*a* and 22*a*, respectively. In order to fill the tank 14 with the desired amount of cryogenic slush, the fill line 20 is connected to a source of liquid carbon dioxide while the vapor return line 22** is connected to a vapor recovery system, which would incorporate a compressor. Examples of systems for filling vessels or tanks with carbon dioxide slush are illustrated in U.S. Pat. No. 4,127,008, the disclosure of which is incorporated herein by reference.

As an example, liquid carbon dioxide at a pressure slightly above the triple point pressure could be supplied to the tank 14 until it has been filled to the desired level, and a suitable level control (not shown) might be incorporated for this purpose. The vapor recovery system would be operating to remove $CO_2$ vapor from the tank 14 as the filling progresses and then to continue to operate to remove vapor. When the triple point pressure is reached, liquid carbon dioxide would begin to turn to solid as evaporation continues as a result of the withdrawal of $CO_2$ vapor, and the pressure within the tank 14 would remain at the triple point pressure. Compressor operation would continue until the desired percentage of solid $CO_2$ is achieved in the slush. Depending upon the design of the tank 14, after slush-making has progressed to a certain extent, additional liquid $CO_2$ may be added to replace the evaporated and withdrawn cryogen so that the desired number of pounds of cryogen slush is present in the storage tank 14 at the start of the delivery day. The tank 14 would also be equipped with a pressure relief valve 24 which would be appropriately set to vent $CO_2$ vapor before the design safety limit is reached.

A liquid line 26 leads from a lower location in the tank 14 and includes a remote-control valve 28 which is opened or shut by a signal which it receives from the control system 18. The liquid line 26 contains a tee 30, the purpose of which is explained hereinafter, and connects to a first heat-exchanger or vaporizer 32. In order to prevent the solid $CO_2$ portion of the slush in the tank 14 from being carried through the liquid line 26, a suitable separator 34, as for example a screen of appropriate mesh size, is provided about the entrance to the liquid line. The separator 34 may be used in conjunction with other means, as hereinafter explained.

The vaporizer 32 can be located in a lower portion of the enclosure 16 in the cargo compartment so that gravity can be relied upon to assure the flow of liquid $CO_2$ from the upper location of the storage tank 14. Alternatively, a flow inducing device, for example a pump, can be included in the liquid line 26 to assure satisfactory flow. An example of a pump which performs a dual function is described and illustrated with respect to the FIG. 3 embodiment.

When the control system is actuated, a temperature sensor 34 appropriately located in the cargo compartment 12 reads the temperature and appropriately causes cooling to be effected by opening the valve 28. The exterior surface of the vaporizer 32 is formed with an extended heat-exchange surface, for example, transversely or radially extending fins, and its length or capacity is designed so that the latent heat of evaporation of all of the cryogen plus some sensible heat will be absorbed in the vaporizer 32. A sensor 36 may be provided at the outlet from the vaporizer 32 which will cause the control system 18 to promptly close the feed valve 28 should the presence of liquid, or vapor of too cold a temperature, be detected. Preferably, the system is such that the cryogen vapor will also absorb sufficient sensible heat in the vaporizer to prevent the formation of snow in subsequent operations. For example, $CO_2$ vapor might be warmed to about −30° F. or higher.

A back-pressure regulator 38 is provided in the vapor line leading from the vaporizer 32 to maintain a minimum pressure, e.g., 75 psia, for the purpose of preventing the formation of snow therein. On the downstream side of the pressure regulator 38, the vapor line is branched at a tee 40, and the vapor stream is split into two parts. One portion is routed through the pipe 42 leading to a compressor 44 which returns the vapor through a line 46 to the storage tank 14. The returning vapor can be injected in such a manner as to assist the separator 34, e.g., by injection into a region adjacent the separator to keep this region relatively free of solid $CO_2$. The other portion flows through a line 48 to a gas motor 50 where it is expanded to drive a rotary shaft which carries a fan or a blower 52 at one end and the other end of which is connected by a clutch 54 to the compressor 44. Generally, between about 30 and 40 volume percent of the total vapor stream is routed to the compressor 44; however, this may be varied depending upon operating conditions and the percent of solids in the slush in tank 14. The pressure of the vapor entering the compressor should be between about 25 and 75 psia.

Under preferred operating conditions, the $CO_2$ vapor in the line leaving the vaporizer 32 will have been warmed sufficiently above the equilibrium temperature at which it was created in the vaporizer that, upon subsequent expansion, there is no creation of solid $CO_2$. For example, if the liquid $CO_2$ entering the vaporizer 32 is essentially at the triple point (about 75 psia and −70° F.), the vapor exiting through the pressure regulator may be at a temperature of about −30° F. The main portion of the gas stream will be routed through the branch line 48 to the gas motor 50 wherein it undergoes isentropic expansion which results in a lowering of the vapor pressure accompanied by lowering of the temperature, for example to about −85° F.

This cold vapor from the gas motor 50 is then directed through a line 56 leading to a second heat-exchange coil 58 which is located in the path of the blower 52 that is driven by the gas motor 50. As depicted in FIG. 2, the blower 52 also directs the circulating atmosphere from the cargo compartment past the main heat-exchanger or vaporizer 32. As a result, the expanded cold $CO_2$ vapor absorbs additional heat from the cargo compartment atmosphere, thus contributing to the overall refrigeration efficiency of the system.

Although the vapor from the heat-exchange coil 58 could be vented, without making some provision to guard against the creation of $CO_2$ snow, if it had been heated to a high enough temperature in the coil 58, such a temperature would not be achieved where frozen foods are being delivered, and preferably the pressure of the cryogen is dropped in two stages rather than in a single gas motor. Accordingly, the vapor exiting the second heat-exchange coil 58, e.g., rewarmed to about −30° F., flows through a line 60 to the entrance to a second gas motor 62 which is drivingly connected to a second blower or fan 64. The $CO_2$ vapor is isentropically expanded in the second gas motor 62 to nearly atmospheric pressure—lowering the temperature of the vapor to, for example, about −100° F. as perfect isentropic expansion is not practically achieved.

This re-cooled vapor from the gas motor 62 is directed through a line 66 to a third heat-exchange coil 68 which is positioned in the circulation flow path created by the second blower 64. Thus, this further-expanded vapor extracts additional heat from the circulating cargo compartment atmosphere and contributes to the overall refrigeration efficiency of the system. The rewarmed vapor leaving the third heat-exchange coil 68 is vented to the atmosphere through an exhaust pipe 69 that discharges the $CO_2$ vapor exterior of the cargo compartment of the truck.

The line 42 leading to the compressor 44 contains a remote-controlled shut-off valve 70 which is appropriately linked to a sensor 72 which determines whether there is any solid $CO_2$ remaining in the storage tank 14. In the illustated embodiment, the sensor 72 is a pressure-measuring device disposed in the vapor return line 46 which measures the pressure within the storage tank 14 on the downstream side of the compressor. So long as there is solid $CO_2$ in the storage tank 14, the pressure in the storage tank 14 will try to remain at about the triple point pressure, i.e., about 75 psia, taking into consideration the rate at which vapor is being returned. A significant rise in pressure over a given time interval, above the expected pressure, is indicative of the fact that all the solid $CO_2$ has been melted, and only liquid and vapor remain in equilibrium. When the sensor 72 detects such a significant rise above the expected pressure, the control system causes the remote-controlled valve 70 to be closed, halting further flow of vapor through the line 42 and routing 100% of the vapor through the line 48 leading to the gas motor 50, so long as this condition exists.

The vapor return line 46 leads to a lower location in the storage tank 14 so that the returning vapor is bubbled into the slush mixture where it comes in direct contact with the dispersed solid $CO_2$, promptly effecting its condensation and the accompanying melting of the solid $CO_2$. To assure there is always an adequate vapor reservoir in the upper portion of the storage tank 14 for defrost purposes, as explained hereinafter, a tee 74 is provided in the vapor return line 46 which connects to a branch line 76 containing a pressure regulator 78 which leads to the vapor region of the storage tank 14. By setting the pressure regulator 78 to open at a pressure above the triple point, vapor from the compressor 44 will maintain such a vapor pressure within the storage tank 14 whenever the compressor 44 is operating. Accordingly, if pressure (as opposed to temperature) is being sensed by the sensor 72, detection of pressure above the setting of the regulator 78 will be required to indicate the absence of solid cryogen.

Normally, the lines and the gas motors will be sized so that, so long as there is slush in the tank 14, approximately 30 to 40 percent of the flow of vapor will be through the line 42 to the compressor and 60 to 70 percent of the flow will be through the gas motor circuit. A higher percentage of the vapor might be routed through the line 42 when 1) a large percentage of solid is provided in the original slush mixture and/or 2) delivery schedules or climatic conditions are such that frequent defrost cycles are anticipated. Likewise, the series arrangement of the gas motors 50 and 62 and heat-exchange coils 58 and 68 will be such as to divide the pressure drop (between the downstream side of the regulator 38 and about atmospheric pressure just upstream of the vent) sufficiently so that the expansion at neither of the gas motors will create solid $CO_2$. Moreover, the gas motor output shafts could be mechanically interconnected by a V-belt (not shown) to assure they operate at the same planned speeds. Also, instead of returning vapor from the vaporizer 32 directly to the tank 14, the tee 40 could be placed in the line 60 so that lower pressure vapor would be routed to the compressor.

Alternatively, instead of using a simple on-off control valve 70 just upstream of the compressor 44, a variable flow control valve may be employed which could vary the relative amount of vapor being returned to the tank 14 and being routed through the gas motor arrangement to vent. The downstream pressure sensor 72 could be used in combination with such a variable flow valve, and the control system 18 could be programmed to make adjustments in the opening of the valve 70 depending upon the downstream pressure read by the sensor. In this respect, should the downstream pressure increase and thus indicate that vapor is being returned to the tank 14 at a rate faster than that at which it can be condensed, the control system 18 would adjust the variable valve 70 to cause less $CO_2$ vapor to flow through the line 42. This arrangement would have the advantage of allowing the sizing of the gas motors 50 and 62 so as to more closely maintain desired operating conditions over a broad period of time.

Depending upon the humidity of the atmosphere in the cargo compartment of the vehicle, frost may slowly form on the outer surfaces of the vaporizer 32 or the other heat-exchangers 58,68. A temperature sensor 80 is also provided in the exhaust line 69 for the purpose of detecting frost build-up on the heat-exchanger coils which, if uncorrected, will significantly decrease refrigeration efficiency. Other suitable means could also be employed to detect frost build-up. Detection of frost build-up is accomplished by comparing the temperature read by the sensor 80 in the exhaust line with the temperature of the atmosphere in the cargo compartment as read by the sensor 34. When this temperature comparison shows that the exiting vapor being vented is at too cold a temperature relative to the temperature of the cargo compartment atmosphere, it is an indication that an insulating layer of frost has built up on the heat-exchange surfaces which is preventing effective heat transfer. Various methods of frost removal are possible, including manual removal when so-called "panel-coils" are used for the heat-exchangers 32,58 and 68. The method illustrated in FIG. 2 supplies heat internally to the heat-exchangers to melt and/or dislodge the frost. Upon detection of such a condition, the control system 18 automatically actuates a defrost cycle.

A branch vapor line 82 leads from the vapor portion of the storage tank 14 through a remote-controlled metering valve 84 to a heat-exchanger 86 where it is passed in heat-exchange relationship with a source of heat from the engine of the vehicle, for example, the exhaust gas or the engine coolant. A suitable thermal storage system can also be provided so as to effect defrost when the engine is not operating; however, cargo door openings and attendant intrusion of moisture-bearing air usually occur during delivery periods when the engine is being operated. When the control system 18 actuates the defrost mode, it closes the liquid feed valve 28 and the valve 70 just upstream of the compressor 44. At the same time, it opens a pair of remote-controlled valves 88,89 that are provided in bypass lines 90,91 which will effectively remove both of the gas motors 50,62 from the flow path.

As a result, the $CO_2$ vapor is heated to a temperature of, for example, 50° to 200° F. in the heat-exchanger 86, and the provision of a quantity of slightly warmer $CO_2$ vapor is achieved by setting the pressure regulator 76 to open anytime the pressure in the tank 14 is below about 80–85 psia. The hot vapor from the heat-exchanger 86 is directed through the vaporizer 32, then through the line 48 and the bypass line 90 to the second heat-exchange coil 58, then through the line 60 and the bypass line 91 to the third heat-exchange coil 68, and finally out the exhaust line 69. The flow of the hot gas through the vaporizer 32 and the two heat-exchangers 58,68 causes rapid melting of any water ice which has formed on the exterior heat-exchange surfaces and removes this undesirable insulation to heat transfer. The ending of the defrost mode may be controlled in any suitable manner—for example, by including a time circuit which effects such flow of hot gas for a predetermined time interval. Alternatively, the temperature-monitoring sensor 80 in the exhaust line can be used to detect a significant rise in the temperature of the hot gas being vented which is indicative that elimination of water ice from the heat-exchange surfaces has been effected. Upon completion of the defrost mode, the control system 18 again operates the cooling arrangement normally whenever refrigeration is called for by a rise in the temperature within the cargo compartment 12. If the flow of vapor through the metering valve 84 significantly lowers the pressure in the tank, when refrigeration is again supplied, the compressor 44 may run again for a short time to build the pressure back to the desired level even though there is no solid cryogen left in the tank.

The improved refrigeration arrangement effectively increases the overall refrigeration capacity of a storage tank 14 of a given size. Moreover, the arrangement can be instrumental in saving cryogen because, relative to a tank of liquid cryogen of the same size, a truck 10 having the illustrated cryogen slush arrangement may well return at the end of a delivery day with a substantial quantity of liquid cryogen, which the operation of the support system at the distribution facility can, overnight, return to slush for the next day's delivery operation.

Shown in FIG. 3 is an alternative embodiment of a refrigeration system embodying certain other features of the invention. Individual components which have already been described with regard to the FIG. 2 embodiment are marked with the same reference numerals so as to avoid the need to again describe the totality of the system.

In the FIG. 3 embodiment, a pump 100 is provided in the liquid supply line 26 between the remote-control valve 28 and the vaporizer 32. The pump 100 is suitably powered, as by a 12-volt electric motor connected either to the vehicle electrical system or to some auxiliary power supply. The pump 100 is operated whenever the feed valve 28 is open. Any suitable type of pump may be employed, such as one commonly used to pump subcooled freon. A liquid detection device would likewise be provided downstream of the vaporizer 32 to assure that the cryogen reaching the pressure regulator 38 is completely in vapor form and contains the desired amount of sensible heat. The vapor line is similarly branched downstream of the pressure regulator 38 with one branch 48 leading to a gas motor 50 and the other branch 42 leading back to the storage tank 14 through a remotely-operated, variable flow valve 102. The pump 100 is operated to raise the pressure of the liquid cryogen to a sufficient degree that the resultant higher pressure vapor can be returned through the line 42 to the storage tank 14 without the need of a compressor.

Although only a single gas motor 50 and heat-exchanger 58 are depicted, it should be understood that preferably a pair of gas motors and associated fans would be used (as shown in the FIG. 2 embodiment). The lines and components can be sized so that the pump 100 will usually raise the pressure of the liquid cryogen to a desired level, e.g., between about 80 psia and about 95 psia, or some suitable auxiliary control devices (not shown) can be included that will cause the pump to operate at a rate so as to maintain such a pressure. The back pressure regulator 38 can be employed to assure that a minimum vapor pressure, for example, 80 psia, is maintained so that there will be no difficulty in returning the $CO_2$ vapor to the storage tank 14.

The control system 18 will open the variable flow regulator 102 to the proper extent to achieve the desired proportional flow of vapor back to the storage tank 14. Again, generally about 30 to 40 percent of the vapor will be returned to the tank 14 so long as there is solid $CO_2$ remaining therein; however, this proportion could be varied. The remainder of the vapor, which is usually the major portion of the flow, is routed through the gas motor-heat exchanger combinations in the same manner as described with respect to FIG. 2. Again these components of the system are sized so that the isentropic cooling that is effected in either of the gas motors is insufficient to create solid $CO_2$. As described hereinbefore, when monitoring of the conditions of the storage tank 14 detects a rise in pressure or temperature that is indicative that there is only liquid cryogen remaining in equilibrium with the vapor, the control system 18 will close the variable flow valve 102 and send all of the vapor through the line 48 leading to the gas motor 50.

Although the invention has been described with respect to certain preferred embodiments, it should be understood that various changes and modifications as would be obvious to one having the ordinary skill in this art, particularly modifications as suggested by my above-identified U.S. patents, may be made without deviating from the scope of the invention, which is defined solely by the claims appended hereto. For example, additional gas motors could be included in the circuit so as to lower the pressure in three or more stages instead of in one or two stages. Moreover, one or more isenthalpic expansion devices could be employed either in substitution for or in combination with the illustrated gas motors. Additionally, although one would give up some efficiency, the cryogen vapor exiting from the first or second gas motor could be vented directly to the atmosphere, if desired, instead of being caused to flow through an additional heat-exchanger. Furthermore, it is possible to melt the slush in the tank by simply cooling the vapor instead of condensing it to liquid—by including one or two heat-exchangers which are in contact with the slush within the storage tank. In such an instance, the entire gas stream might be routed through the first gas motor and its associated heat-exchanger, then cooled in one of the heat-exchangers associated with the storage tank and warmed in another heat-exchanger in the cargo compartment, expanded through the second gas motor and routed through its associated heat-exchanger, further cooled in another heat-exchanger associated with the storage tank, and then finally vented after passage through still another heat-exchanger disposed in the cargo compartment.

Various additional features of the invention are emphasized in the claims which follow.

What is claimed is:

1. A method for cooling the cargo compartment of a refrigerated vehicle using carbon dioxide, which method comprises providing reservoir of liquid $CO_2$ and solid $CO_2$ in the form of $CO_2$ slush in a storage tank carried by the vehicle, separating liquid $CO_2$ from the slush and transferring the separated liquid from the tank to first heat-exchange means, vaporizing said transferred liquid $CO_2$ in said first heat-exchange means by heat transfer from the cargo compartment atmosphere while maintaining a vapor pressure of at least about 75 psia therein, returning at least a portion of said $CO_2$ vapor stream from said first heat-exchanger to said vehicle storage tank where additional liquid $CO_2$ is created by melting solid $CO_2$ in said slush, and eventually venting at least a portion of said $CO_2$ vapor stream.

2. A method in accordance with claim 1 wherein at least part of said nonreturned vapor is expanded through a gas motor prior to venting and wherein said $CO_2$ vapor is warmed to such a temperature in said first heat-exchange means that upon expansion of said warmed vapor in the gas motor there is no creation of solid $CO_2$.

3. A method in accordance with claim 2 wherein said expanded $CO_2$ vapor is passed through second heat-exchange means to re-warm said vapor by heat-exchange with the cargo compartment atmosphere.

4. A method in accordance with claim 2 wherein one vapor portion is compressed in a compressor drivingly connected to the gas motor and the compressed vapor is returned to said reservoir where it is condensed in direct contact with said solid $CO_2$.

5. A method in accordance with claim 4 wherein the pressure of said $CO_2$ vapor entering said compressor is maintained at between about 25 psia and about 75 psia.

6. A method in accordance with claim 4 wherein between about 30 and 40 volume percent of the total vapor stream is routed to said compressor.

7. A method in accordance with claim 1 wherein said storage tank is located vertically above said first heat-exchange means and said liquid $CO_2$ is gravitationally transferred thereto.

8. A method in accordance with claim 1 wherein the pressure of said liquid $CO_2$ is increased by pumping to effect said transferring and wherein said vaporizing is carried out at a pressure of at least about 80 psia.

9. A method in accordance with claim 8 wherein said vaporizing is carried out at a pressure between about 80 psia and about 95 psia and wherein one vapor portion is returned without repressurizing to said reservoir where it is condensed in direct contact with said solid $CO_2$.

10. A method in accordance with claim 1 wherein said return of vapor to said storage tank is automatically halted when said solid $CO_2$ is completely melted.

11. A method in accordance with claim 10 wherein said automatic halting is initiated upon the detection of a predetermined pressure in the storage tank which is significantly above the triple point pressure.

12. A system for cryogenically cooling a cargo compartment of a refrigerated vehicle, which system includes a storage tank carried by the vehicle, means for filling said storage tank with a mixture of liquid cryogen and solid cryogen in the form of slush, heat-exchange means for vaporizing liquid cryogen and for warming the vapor by heat transfer from the cargo compartment atmosphere, means for separating liquid cryogen from solid cryogen in said tank and for supplying said liquid to said heat-exchange means, pressure regulation means for maintaining a minimum vapor pressure of at least about 5 psi about the triple point in said heat-exchange means, means for returning at least a portion of said vapor to said vehicle storage tank to melt solid cryogen in said tank, and means for venting at least a portion of said vapor.

13. A system in accordance with claim 12 wherein gas-driven motor means is provided and wherein means is provided for conducting at least a portion of the warm vapor from said heat-exchange means to said gas-driven motor means.

14. A system in accordance with claim 13 wherein compressor means is connected to said gas-driven motor means and said portion of the vapor being returned is discharged by said compressor means into direct contact with the slush in said compressor means.

15. A system in accordance with claim 14 wherein a variable flow regulator is provided upstream of said compressor means and means is provided for sensing the vapor pressure downstream of said compressor and for adjusting said variable flow regulator accordingly.

16. A system in accordance with claim 13 wherein fan means is also connected to said gas motor means for circulating the atmosphere in said cargo compartment in association with said heat-exchange means.

17. A system in accordance with claim 12 wherein pump means is provided between said storage tank and said heat-exchange means for raising the pressure of the liquid cryogen which is to be vaporized therein and wherein said return means injects said portion of said vapor into direct contact with the solid cryogen in said resevoir where it is condensed to liquid.

* * * * *